United States Patent [19]

Foradori

[11] Patent Number: 4,836,331

[45] Date of Patent: Jun. 6, 1989

[54] LADDER SAFETY DEVICE-ANTISLIP

[76] Inventor: Paul T. Foradori, 7427 Lincolnshire La., Parma, Ohio 44134

[21] Appl. No.: 192,969

[22] Filed: May 12, 1988

[51] Int. Cl.[4] ..... E06C 5/36

[52] U.S. Cl. ..... 182/107; 182/201

[58] Field of Search ..... 182/204, 205, 201, 203, 182/202, 107, 108

[56] References Cited

U.S. PATENT DOCUMENTS

| | | | |
|---|---|---|---|
| 1,015,940 | 1/1912 | Chickering | 182/107 |
| 1,346,831 | 7/1920 | Lehmann | 182/111 |
| 2,127,035 | 8/1938 | Kirlin | 182/107 |
| 2,145,619 | 1/1939 | Brown | 182/107 |
| 2,313,469 | 3/1943 | Forsman | 182/201 |
| 4,694,932 | 9/1987 | Schmitt | 182/109 |

FOREIGN PATENT DOCUMENTS

| | | | |
|---|---|---|---|
| 3402677A | 1/1984 | Fed. Rep. of Germany | 182/109 |
| 661093 | 6/1987 | Switzerland | 182/107 |

*Primary Examiner*—Reinaldo P. Machado
*Attorney, Agent, or Firm*—Paul Foradori

[57] ABSTRACT

A device which is easily attached to the stiles of any ladder. This highly reliable device creates a steadfast ladder, removing the fear of the ladder flipping over or slipping out from under. This device is created in such a manner as to be attached to any ladder and also having a clearance to allow for any shoes attached or to be attached to the ladder's base. Ground penetration is easily achieved by the spike's ability to rotate. The design of the device allows ground penetration to any depth, making allowances for obstructions. Safety is achieved by the device's ability to stabilize the ladder's lower end. The handle lies flat against the ladder's stiles creating a self-contained unit that is out of the way when not in use.

5 Claims, 2 Drawing Sheets

LADDER SAFETY DEVICE-ANTISLIP

BACKGROUND

1. Field of Invention

The present invention relates to an improved structural anti-slip device for supporting a ladder's lower end in various terrain.

2. Description of Prior Art

It has been long known in the construction arts the problems related to the lack of support at the base of the ladder. Various methods have been introduced to alleviate these problems, such as pivotal shoe members. Such methods do not assure firm grasp on varying terrain. Different methods of securing the ladder's base have been introduced in the forms of star-shaped attachments and spike-like objects which penetrate the ground.

Devices of penetrating qualities lacked in several different areas, such as the star-shaped attachment, which only pierced the ground. The spike in U.S. Pat. No. 2,145,619 to Brown, Jan. 28, 1938 which is square or flat shaped, does not permit easy ground penetration. The spike is restricted in its twisting ability, which creates difficulties when it comes to pushing the spike into the ground. Another problem related to the shape of the spike is that the handle/foot of the spike will aways stick out and may not be tucked away for safety. The spike in the said patent must penetrate the ground to the same depth every time due to the indents, which does not make allowance for obstructions, such as large rocks and the like.

OBJECTS AND ADVANTAGES

Accordingly I claim the following as the objects and advantages of the invention: to provide a device which will secure the lower end of a ladder on various terrain, regardless of the depth of penetration allowable, and to provide such a device which is constructed as one unit, with no assembly, and no parts which are easily lost.

In addition, I claim the following additional objects and advantages: to provide a device which will allow safer ascension of the ladder while carrying heavy objects to the top without the ladder flipping over or slipping out from under.

Readers will find further objects and advantages of the invention from consideration of the ensuing description and the accompanying drawings.

DRAWING FIGURES

DRAWING REFERENCE NUMERALS

Figure 1:
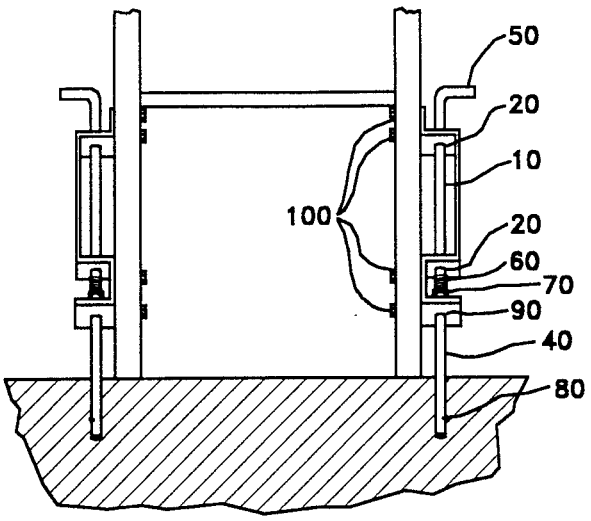
FIG. 1 is a side elevation of the lower portion of a ladder showing two of the anti-slipping devices carried by the stiles thereof.
Figure 2:
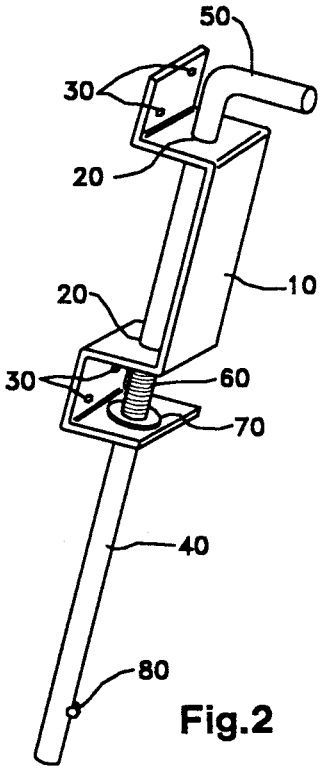
FIG. 2 shows a view of such tool in the position of ground penetration.
Figure 3:
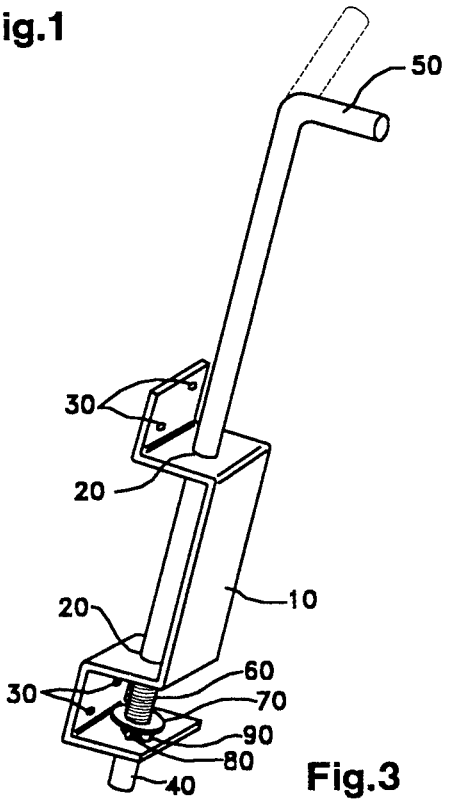
FIG. 3 shows a view of such tool in the self-contained position with handle rotated to a stationary position.

10, one-piece, multi-bent, metal strip
20, spike-guiding openings in 10
30, affixing holes in 10
40, spike

50, handle for 40
60, coiled compression spring surrounding 40
70, retaining ring surrounding 40
80, nipple on 40
90, release channel in 10
100, bolts for 30

TOOL DESCRIPTION

A preferred embodiment of my invention has been shown and will be explicitly described. Understand that within the scope of the invention as claimed, minor variations may be made.

Two of the anti-slipping devices are shown in FIG. 1; as both devices are identical, a detailed description of one will suffice.

Figure 4:
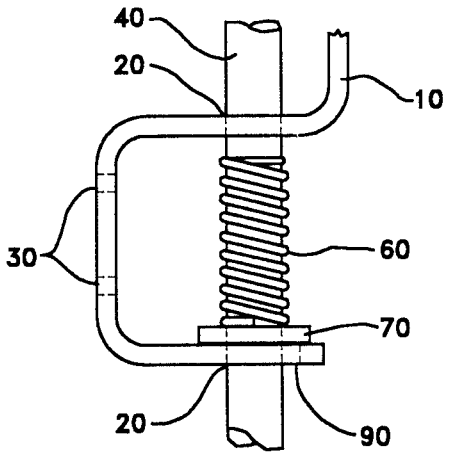
FIG. 4 shows a detail view of the compression harbor with the spike in its use position.
Figure 5:
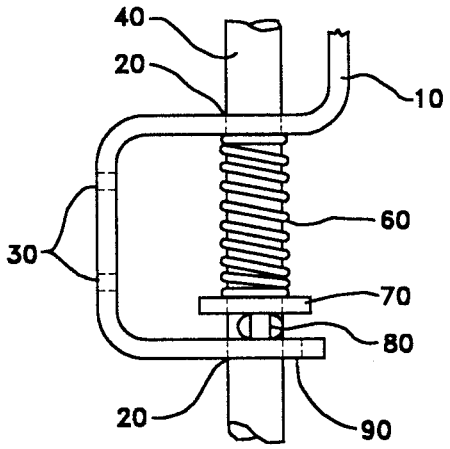
FIG. 5 shows a detail view of the compression harbor with the spike in its non-use position.

A one-piece metal strip 10, preferably formed from iron, steel, or any durable substance, [which] is secured to the outer stile of the ladder by the use of bolts or rivets 100 through the affixing holes 30. There are five ninety-degree angles in the one-piece metal strip 10, in said angles there are spike-guiding openings 20 in which a spike 40, made of any durable material, passes through said metal strip 10. The spike 40 forms a ninety-degree angle at the top, thus forming the handle 50. The release channel 90, which is the last opening through which the spike 40 passes, is constructed to permit the nipple 80 to clear only when the handle 50 is positioned at a ninety-degree angle from the stile. FIG. 4 is an exploded view of the coiled compression spring 60, the retaining ring 70, and the release channel 90, all of which the spike 40 passes through. The nipple 80 is also shown in FIG. 5 (under compression).

TOOL OPERATION

The following is a detailed description of operation for the anti-slip device. This device is a one-piece unit requiring no assembly and is easy to install on any ladder. The metal strip 10 is attached to the ladder's stiles with bolts 100 through the affixing holes 30. Once the anti-slip devices are fastened to the ladder's stiles, it is ready for use.

By turning the handle 50 ninety degrees from the stile, the nipple 80 slips through the release channel 90 due to the pressure exerted from the coiled compression spring 60 and the retaining ring 70. The releasing of the nipple 80 allows the spike 40 to be pushed down through the spike-guiding openings 20, penetrating the ground as far as is necessary or allowed. Following the same procedure for the other anti-slip device, the ladder is now ready to be climbed.

FIG. 4 shows an exploded view of the coiled compression spring 60 which is pushing down on the retaining ring 70 so as to be flush against the metal strip 10. When ladder use is complete, all that is needed is to grasp the handle 50 and pull, thereby raising the spike 40 up through the spike-guiding openings 20, keeping the handle 50 at a ninety-degree angle from the stile. Once the nipple 80 passes through the release channel 90, then the handle 50 is rotated ninety degrees towards the stile. When the nipple 80 clears the release channel 90 the retaining ring 70 pushed the coiled compression spring 60 up, creating tension. This tension is what maintains the handle's 50 position against the ladder's stile while not in use. This provides a complete self-contained unit.

FIG. 5 shows a detailed view of the nipple 80 lying above the release channel 90 and the tension created by the coiled compression spring 60 and the retaining ring 70.

Thus the reader will see that this anti-slip device provides an answer to the problems related to the instability of ladders.

the invention provides a highly reliable, light-weight, economical device which any person using a ladder will find easy to use.

While my above description contains many specifics, these should not be construed as limitations on the scope of the invention, but rather as an exemplification of one preferred embodiment thereof. Those skilled in the art will envision many other possible variations. For example, skilled artisans will readily be able to change the dimensions and shapes of the preferred embodiment. They would be able to substitute any strong and durable material in the construction of the device. They could design a pointed end for ground penetration. They could redesign the shape of the metal strip or handle. Many other variations are possible. Accordingly, the scope of the invention should be determined, not by the embodiment illustrated, but by the appended claims and their legal equivalents.

We claim:

1. A device attachable to the stiles of a ladder to stabilize said ladder against slipping, said device comprising:

a. a ground-penetrating spike of substantially circular cross-section and having a keylike protruberance at a point along the length thereof;

b. an elongated bent metal strip attachable to the stiles of a ladder, said strip having openings to receive attaching bolts and openings to guide said spike for axial and rotational motion thereof, one of said openings having a keyway to selectively permit or prevent passage of said keylike protuberance;

c. a compression harbor formed by said metal strip, said harbor comprising a retaining ring surrounding said spike and adjacent said keywayed opening, wherein said ring is biased by a spring means to engage said protruberance and to hold it against a surface of said strip when said spike is in a retracted non-use position, thereby to frictionally restrict rotational motion of said spike thus to stabilize said spike in a non-use position;

d. a handle fixedly attached to said spike substantially orthogonal thereto and useful for moving said spike in axial and rotational motion, said handle may be formed by bending said spike.

2. The device of claim 1, wherein said spike is cylindrical, thereby making the task of ground penetration easy by allowing said spike to be rotated by means of said handle and allowing said handle to lie against the ladder's stiles in a tucked away position.

3. The device of claim 1, wherein said protuberance on said spike is a nipple which passes through said keywayed hole.

4. The device of claim 1, wherein said compression harbor allows said spike to achieve various depths of ground penetration with no restrictions.

5. The device of claim 1, wherein said elongated metal strip is bent to allow clearance for any shoes that may be attached to the base of said ladder.

* * * * *